US005952282A

United States Patent [19]

Löffler et al.

[11] Patent Number: 5,952,282

[45] Date of Patent: Sep. 14, 1999

[54] SULFONYLIMINE DERIVATIVES AS BLEACH CATALYSTS

[75] Inventors: Matthias Löffler, Niedernhausen; Gerd Reinhardt, Kelkheim, both of Germany

[73] Assignee: Clariant GmbH, Frankfurt, Germany

[21] Appl. No.: 08/902,670

[22] Filed: Jul. 30, 1997

[30] Foreign Application Priority Data

Aug. 19, 1996 [DE] Germany ..... 196 33 305

[51] Int. Cl.[6] ..... C11D 7/26; C11D 7/32; C11D 7/54

[52] U.S. Cl. ..... 510/376; 252/186.38; 252/186.39; 510/372; 510/494; 510/303; 510/314; 562/430; 564/89

[58] Field of Search ..... 510/372, 376, 510/494, 303, 314; 252/186.38, 186.39; 562/430; 564/89

[56] References Cited

U.S. PATENT DOCUMENTS 2,864,770 12/1958 McCune et al. ..... 252/138
2,940,938 6/1960 Blinka ..... 252/309
3,368,977 2/1968 Tuvell ..... 252/137
5,041,232 8/1991 Batal et al. ..... 252/94
5,047,163 9/1991 Batal et al. ..... 252/102
5,413,733 5/1995 Nicholson et al. ..... 252/186.42

*Primary Examiner*—Margaret Einsmann
*Assistant Examiner*—Gregory R. Delcotto
*Attorney, Agent, or Firm*—Scott E. Hanf

[57] ABSTRACT

The use is claimed of compounds of the general formula

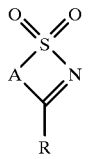

in which the radicals A and R are as defined in the description. The novel compounds are employed as bleach catalysts in bleaching detergents and cleaning products.

5 Claims, No Drawings

SULFONYLIMINE DERIVATIVES AS BLEACH CATALYSTS

This invention relates to the use of sulfonylimine derivatives as novel bleach catalysts, and to detergent compositions which comprise these compounds as bleach catalysts.

It is known that the bleaching power of peroxide bleaches such as perborates, percarbonates, persilicates and perphosphates can be improved so that bleaching begins at lower temperatures, for instance at or below 60° C., by adding the precursors of bleaching peroxy acids, which are often referred to as bleach activators.

Numerous substances are known in the prior art as bleach activators. They are usually reactive organic compounds having an O-acyl or N-acyl group, which combine in alkaline solution with a source of hydrogen peroxide to form the corresponding peroxy acids.

Representative examples of bleach activators are N,N,N',N'-tetra-acetylethylenediamine (TAED), glucose pentaacetate (GPA), xylose tetraacetate (TAX), sodium 4-benzoyloxybenzenesulfonate (SBOBS), sodium trimethylhexanoyloxybenzenesulfonate (STHOBS), tetraacetylglycoluril (TAGU), tetraacetylcyanic acid (TACA), di-N-acetyl-dimethylglyoxine (ADMG) and 1 -phenyl-3-acetylhydantoin (PAH). Reference may be made, for example, to GB-A-836 988, GB-A-907 356, EP-A-0 098 129 and EP-A-0 120 591.

A common feature of these bleach activators is that they are not catalytically active. As soon as the peroxy acid precursor, for example an ester or imide, has been perhydrolysed, it cannot be regenerated. As a consequence, relatively large amounts of bleach activator are required. Its proportion by weight in detergent compositions is up to 8%.

Stimulated by work in the field of oxidation of organic substances, compounds with activated CN double bonds were recognized as effective oxidation catalysts. Building on the results of Hanquet et al., for example, quaternary imines and their corresponding oxaziridinium salts were employed as bleach catalysts in the washing of textiles (Hanquet, Lusinchi, Milliet, Tetrahedron Lett. 1988, 3941; Hanquet, Lusinchi, Milliet, Acad. Sci. Paris. 1991 Series II, 625; Hanquet, Lusinchi, Milliet, Tetrahedron Lett. 1988, 2817; WO-A-95/13352, U.S. Pat. Nos. 5,442,066, 5,360,568, 5,370,826). Since such bleach catalysts are not, or not greatly, consumed, because they are always regenerated within one catalytic cycle, the amount of material required, when they are used in detergents, is less by several orders of magnitude than when conventional bleach activators are used.

Sulfonylimines of the formula

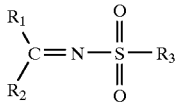

constitute in this context a particular class of metal-free bleach catalysts, since they are highly effective. Bleach catalysts of this kind and their derivatives are described, for example, in EP 446 982, EP-A-446 981 and U.S. Pat. No. 5,429,768.

It has surprisingly now been found that sulfonylimines which are derived from 3-substituted benzoisothiazole 1,1-dioxides show a better bleaching performance than the catalysts of the prior art.

Compounds of this kind are described in Z. Analyt. Chem. 220, 9 (1966) and J. Org. Chem. 20, 1425 (1955).

The invention therefore provides for the use of compounds of the formula

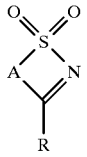

as bleach catalysts, in which R is one of the groups

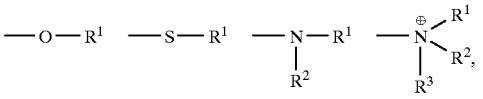

$R^1$ is $C_1$- to $C_{24}$-alkyl, $C_2$–$C_{24}$-alkenyl, aryl, alkylaryl or $C_1$–$C_4$-alkoxy-$C_1$–$C_4$-alkyl, $R^2$ is hydrogen, $C_1$- to $C_{24}$-alkyl, $C_2$–$C_{24}$-alkenyl, aryl, alkylaryl or $C_1$–$C_4$-alkoxy-$C_1$–$C_4$-alkyl, $R^3$ is hydrogen, $C_1$- to $C_4$-alkyl, $C_2$–$C_4$-alkenyl, phenyl or benzyl, or $R^1$ and $R^2$ together form a 5- to 7-membered heterocycle which as well as the nitrogen atom also contains an oxygen atom in the ring, A is a radical of the formulae (a) to (d)

(a)

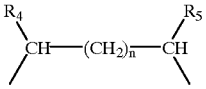

(b)

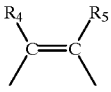

(c)

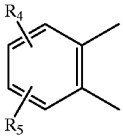

(D)

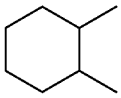

n is the number 0, 1 or 2, $R_4$ is hydrogen, $C_1$- to $C_{24}$-alkyl, $C_2$–$C_{24}$-alkenyl, aryl, alkylaryl or $C_1$–$C_4$-alkoxy-$C_1$–$C_4$-alkyl, $R_5$ is hydrogen, chlorine, bromine or a group of the formula —$SO_3M$, —$CO_2M$, —$CO_3M$ or —$OSO_3M$, and M is hydrogen, an alkali metal ion or ammonium ion or the equivalent of an alkaline earth metal ion.

A is preferably a radical of formula (C) with $R_4$, $R_5$=H.

$R_1$ is preferably $C_1$- to $C_4$-alkyl, $C_2$- to $C_4$-alkenyl or phenyl. $R_2$ is preferably hydrogen or $C_1$- to $C_4$-alkyl. If $R_1$ and $R_2$ together form a morpholine ring, then its nitrogen atom is preferably quaternized with a methyl group, i.e. $R_3$ is methyl.

Particularly preferred 3-substituted benzoisothiazole 1,1-dioxides according to the invention are those which can be derived (a) from simple alcohols, such as 3-ethoxybenzoisothiazole 1,1-dioxide, 3-dimethylaminoethoxybenzoisothiazole 1,1-dioxide;

(b) from simple amines, such as 3-(N-morpholino) benzoisothiazole 1,1-dioxide, 3-dimethylaminobenzoisothiazole 1,1-dioxide; and (c) from their corresponding quaternary ammonium compounds.

A general example will be used to represent the synthetic pathways leading to the benzoisothiazole 1,1-dioxide derivatives of this invention.

1. Pseudosaccharine chloride (prepared from saccharine and $PCl_5$ according to Jesurun, Ber. Chem. Ges. (1893) 26, 2286; Böhme, Opfer, Z. Analyt. Chem. (1953) 139, 255) and excess alcohol are initially introduced and are heated for from 10 minutes to 2 hours at temperatures between 50 and 140° C., preferably to the boiling temperature of the alcohol employed. The reaction is at an end as soon as HCl gas is no longer formed. Excess alcohol is removed in vacuo. When using higher alcohols, it is preferred to employ stoichiometric amounts with addition of an inert solvent. An excess of pseudosaccharine chloride is also suitable, in which case the product mixture is worked up by adding aqueous base.

2. Pseudosaccharine chloride is initially introduced in an appropriate solvent. At temperatures between 10 and 60° C., preferably at room temperature, a secondary amine is added dropwise over the course of from 0.5 to 3 hours. A colorless precipitate is formed immediately. After subsequent stirring for a period of about 1 hour, an auxiliary base, for example pyridine, is added dropwise in excess and, after a further 1-hour period of subsequent stirring, the solvent is removed in vacuo. The residue obtained is purified by being stirred with water and thus extracted.

3. 3-Aminobenzoisothiazole 1,1-dioxide is taken up in an organic solvent and reacted with a methylating agent, such as methyl chloride or dimethyl sulfate, at temperatures between 20 and 100° C., preferably between 70 and 80° C., to give the corresponding 3-ammonio-benzoisothiazole 1,1-dioxide salt.

4. Pseudosaccharine chloride is initially introduced in an appropriate solvent, and a tertiary amine is added dropwise at temperatures between 10 and 60° C., preferably at room temperature, over the course of from 0.5 to 3 hours. A colorless precipitate is formed immediately. After subsequent stirring for a period of about 6 hours, the resulting precipitate is isolated.

The invention also provides bleaching detergents and cleaning products which comprise the novel bleach catalysts. These detergents and cleaning products usually, in addition to a peroxy compound and the bleach catalyst, also include surface-active compounds and other ingredients.

Suitable peroxy compounds are alkali metal peroxides, organic peroxides such as urea peroxide, and inorganic per salts, such as the perborates, percarbonates, perphosphates, persilicates and persulfates of alkali metals. Mixtures of two or more of these compounds are likewise suitable. Particular preference is given to sodium perborate tetrahydrate and, in particular, to sodium perborate monohydrate.

Sodium perborate monohydrate is preferred on account of its good stability in storage and its ready solubility in water. Sodium percarbonate may be preferred on environmental grounds.

Alkyl hydroperoxides constitute a further suitable group of peroxy compounds. Examples of these substances are cumene hydroperoxide and t-butyl hydroperoxide.

In detergents and cleaning products of this kind the content by weight of the novel bleach catalyst can be from about 0.05% to 10%, preferably from 0.2% to 5%, together with a peroxy compound. The proportion by weight of these peroxy compounds is usually from 2% to 40%, preferably from 4% to 30%, and in particular from 10% to 25%.

The detergents and cleaning products may also, in addition to the novel bleach catalysts, comprise other suitable bleach activators, for example TAED, tetraacetylglycoluril, glucose pentaacetate, sodium nonanoyloxybenzenesulfonate, benzoylcaprolactam or nitrilic activators. These additional bleach activators can be present in an amount from 1 to 10% by weight.

The surface-active substance can be derived from natural products, such as soap, or can be a synthetic compound from the group consisting of anionic, nonionic, amphoteric, zwitterionic and cationic surface-active substances or mixtures thereof. Numerous suitable substances are obtainable commercially and are described in the literature, for example in "Surface active agents and detergents", Vol. 1 and 2, by Schwartz, Perry and Berch. The overall proportion of the surface-active compounds can be up to 50% by weight, preferably from 1% by weight to 40% by weight and, in particular, from 4% by weight to 25% by weight.

Synthetic anionic surface-active substances are customarily water-soluble alkali metal salts of organic sulfates and sulfonates having alkyl radicals of about 8 to 22 carbon atoms, the expression "alkyl" including the alkyl substituents of higher aryl radicals.

Examples of suitable anionic detergents are sodium and ammonium alkyl sulfates, especially the sulfates obtained by sulfation of higher ($C_8$ to $C_{18}$) alcohols; sodium and ammonium alkylbenzenesulfonates having an alkyl radical of $C_9$ to $C_{20}$, especially linear secondary sodium alkylbenzenesulfonates having an alkyl radical of $C_{10}$ to $C_{15}$; sodium alkyl glycerol ether sulfates, especially the esters of the higher alcohols derived from tallow oil and coconut oil; the sodium sulfates and sodium sulfonates of coconut fatty acid monoglycerides; sodium and ammonium salts of the sulfuric esters of higher ($C_9$ to $C_{18}$) alkoxylated fatty alcohols, especially those alkoxylated with ethylene oxide; the products of the esterification of fatty acids with isethionic acid followed by neutralization with sodium hydroxide; sodium and ammonium salts of the fatty acid amides of methyltaurine; alkanemonosulfonates, such as those from the reaction of $\alpha$-olefins ($C_8$–$C_{20}$) with sodium bisulfite and those from the reaction of paraffins with $SO_2$ and $Cl_2$ followed by basic hydrolysis, which gives a mixture of different sulfonates; sodium and ammonium dialkyl sulfosuccinates having alkyl radicals of $C_7$ to $C_{12}$; and olefinsulfonates which are formed in the reaction of olefins, especially $C_{10}$- to $C_{20}$-$\alpha$-olefins, with $SO_3$ followed by hydrolysis of the reaction products. The preferred anionic detergents are sodium alkylbenzenesulfonates with alkyl radicals of $C_{15}$ to $C_{18}$, and sodium alkyl ether sulfates with alkyl radicals of $C_{16}$ to $C_{18}$.

Examples of suitable nonionic surface-active compounds, which are preferably used together with anionic surface-active compounds, are, in particular, the reaction products of alkylene oxides (usually ethylene oxide) with alkylphenols (alkyl radicals of $C_5$ to $C_{22}$), the reaction products generally containing from 5 to 25 ethylene oxide (EO) units in the molecule; the reaction products of aliphatic ($C_8$ to $C_{18}$) primary or secondary, linear or branched alcohols with ethylene oxide, having in general from 6 to 30 EO, and the adducts of ethylene oxide with reaction products of propylene oxide and ethylenediamine. Other nonionic surface-active compounds are alkyl polyglycosides, long-chain tertiary amine oxides, long-chain tertiary phosphine oxides and dialkyl sulfoxides.

Amphoteric or zwitterionic surface-active compounds can likewise be used in the novel compositions, although this is usually not preferred owing to their high cost. If amphoteric or zwitterionic compounds are used, they are generally employed in small amounts in compositions predominantly comprising anionic and nonionic surfactants.

Soaps as well can be used in the novel compositions, preferably in a proportion of up to 25% by weight. They are particularly suitable in small amounts in binary (soap/anionic surfactant) or in ternary mixtures together with nonionic or mixed synthetic anionic and nonionic surfactants. The soaps used are preferably the sodium salts, and less preferably the potassium salts, of saturated or unsaturated $C_{10}$ to $C_{24}$ fatty acids, or mixtures thereof. The proportions of such soaps can be from 0.5% by weight to 25% by weight; smaller amounts of from 0.5% by weight to 5% by weight are generally sufficient for foam control. Proportions of soaps of between about 2% and about 20%, in particular between about 5% and about 10%, have a positive effect. This is especially the case in hard water, where the soap acts as an additional builder substance.

The detergents and cleaning products generally also include a builder. Suitable builders are calcium-binding substances, precipitants, calcium-specific ion exchangers and mixtures thereof. Examples of calcium-binding substances include alkali metal polyphosphates, such as sodium tripolyphosphate; nitrilotriacetic acid and its water-soluble salts; the alkali metal salts of carboxymethyloxysuccinic acid, ethylenediaminetetraacetic acid, oxydisuccinic acid, mellitic acid, benzenepolycarboxylic acids, citric acid; and polyacetal carboxylates, as disclosed in U.S. Pat. Nos. 4,144,226 and 4,146,495.

Examples of precipitants are sodium orthophosphate, sodium carbonate and soaps of long-chain fatty acids.

Examples of ion exchangers which are specific for calcium include the various types of water-insoluble, crystalline or amorphous aluminum silicates, of which the zeolites are the best-known representatives.

These builder substances can be present in a proportion of from 5% by weight to 80% by weight, preferably from 10% by weight to 60% by weight.

In addition to the ingredients already mentioned, the detergents and cleaning products may include any of the conventional additives in amounts which are customary in such compositions. Examples of these additives include foam formers, such as alkanolamides, especially the monoethanolamides of palm kernol oil fatty acids and coconut fatty acids; foam inhibitors, such as alkyl phosphates and alkylsilicones, graying inhibitors (antiredeposition agents) and similar auxiliaries, such as sodium carboxymethylcellulose and alkyl- or substituted alkylcellulose ethers; stabilizers, such as ethylenediaminetetraacetic acid; softeners for textiles, inorganic salts, such as sodium sulfate; and, in usually small amounts, fluorescent substances, perfumes, enzymes such as proteases, cellulases, lipases and amylases, disinfectants and colorants. The bleach catalysts of this invention can be employed in a large number of products, including textile detergents, textile bleaches, surface cleaners, toilet cleaners, dishwasher detergents, and also denture cleansers. The detergents can be in solid or liquid form.

For reasons of stability and ease of handling it is advantageous to use the bleach catalysts in the form of granules which in addition to the bleach catalyst comprise a binder. Various methods of producing such granules are described in the patent literature, for example in CA 1 102 966, GB 1 561 333, U.S. Pat. No. 4,087,369, EP-A-0 240 057, EP-A-0 241 962, EP-A-0 101 634 and EP-A-0 062 523. Any of these methods can be employed for the novel bleach catalysts.

The granules containing the bleach catalysts are generally added to the detergent composition together with the other dry constituents, such as enzymes and inorganic peroxide bleaches. The detergent composition to which the catalyst granules are added can be obtained by various methods, for example dry mixing, extrusion or spray drying.

In a further embodiment the novel bleach catalysts are particularly suitable for nonaqueous liquid detergents, together with a bleaching peroxide compound, for instance sodium perborate, in order to give the detergent a high cleaning capacity for fabrics and textiles. Nonaqueous liquid detergents of this kind, which include pasty and gelatinous detersive compositions, are known in the prior art and are described, for example, in U.S. Pat. Nos. 2,864,770, 2,940,938, 4,772,412, 3,368,977, GB-A-1 205 711, GB-A-1 370 377, GB-A-1 270 040, GB-A-1 292 352, GB-A-2 194 536, DE-A-2 233 771, and EP-A-0 028 849.

These compositions are in the form of a nonaqueous liquid medium in which a solid phase may be dispersed. The nonaqueous liquid medium can be a liquid, surface-active substance, preferably a nonionic surface-active substance; a nonpolar liquid medium such as liquid paraffin; a polar solvent, for instance polyols, for example glycerol, sorbitol, ethylene glycol, alone or in conjunction with low molecular mass monohydric alcohols such as ethanol or isopropanol; or mixtures thereof.

The solid phase may consist of builder substances, alkalis, abrasive substances, polymers, other solid ionic surface-active substances, bleaches, fluorescent substances and other customary solid ingredients.

The examples which follow are intended to give an overview of the embodiments of the invention.

EXAMPLE 1

Synthesis of 3-diethylaminobenzoisothiazole 1,1-dioxide 10.0 g of pseudosaccharine chloride are initially introduced in 150 ml of toluene. 3.7 g of diethylamine diluted with 25 ml of toluene are added dropwise at room temperature over the course of 30 minutes. After a further 30 minutes, 50 ml of pyridine in 25 ml of toluene are added and the mixture is subsequently stirred at room temperature for 2.5 hours. The solvent is then removed in vacuo and the residue is stirred up with 350 ml of water. The colorless precipitate is filtered off to give 10.1 g (84%) of 3-diethylaminobenzoisothiazole 1,1-dioxide.

EXAMPLE 2

Synthesis of 3-(N-morpholino)benzoisothiazole 1,1-dioxide 10.0 g of pseudosaccharine chloride are initially introduced in 150 ml of toluene. 4.4 g of morpholine diluted with 25 ml of toluene are added dropwise at room temperature over the course of 30 minutes. Since the reaction is exothermic, the mixture is cooled with an ice bath. After a further 30 minues, 50 ml of pyridine in 25 ml of toluene are added and the mixture is subsequently stirred at room temperature for 2.5 hours. The solvent is then removed in vacuo and the residue is stirred up with 350 ml of water. The colorless precipitate is filtered off to give 10.8 g (86%) of 3-diethylaminobenzoisothiazole 1,1-dioxide.

EXAMPLE 3

Synthesis of 3-triethylammoniobenzoisothiazole 1,1-dioxide chloride 10.0 g of pseudosaccharine chloride are dissolved in 40 ml of acetone, and 5.1 g of triethylamine (diluted with 5 ml of acetone) are added. The reaction temperature is held at room temperature by ice cooling. After stirring for 10 hours, the resultant precipitate is isolated to give 5.3 g (35%) of 3-triethyl-ammoniobenzoisothiazole 1,1-dioxide chloride.

EXAMPLE 4

The combination of 200 ml of an aqueous solution of 5 g/l reference detergent (WMP), obtained from WFK-Testgewebe GmbH, Krefeld, 150 mg of sodium perborate monohydrate (PB*1), 41 mg of TAED and $6 \cdot 10^{-4}$ mol of a catalyst gave a bleach composition. Four pieces of fabric soiled with black tea (BC-1 tea on cotton, 1.25 g, WFK) were added for a thirty-minute isothermal washing experiment in a Linitest apparatus. After the predetermined washing time, the pieces of fabric were rinsed with water, dried and ironed. The bleaching action was then measured by means of an ELREPHO 2000 whiteness meter (Datacolor) by determining the differences in the reflectances before and after bleaching.

The investigations were repeated with different types of soiling (e.g. tea, paprika) and at different temperatures (20° C., 40° C.).

Bleach compositions with the bleach catalysts 1 to 4 were prepared. Their effectiveness was determined by measuring the reflectances of the fabric before and after the bleaching process and comparing them with the differences in reflectance on using the reference detergent. The corresponding ΔΔR values are indicated in Table 1.

$$\Delta\Delta R\ SULF = \Delta R(SULF) - \Delta R(WMP)$$

The compounds 1 to 4 are

1

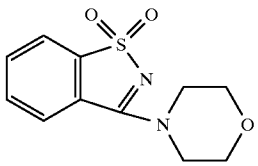

2

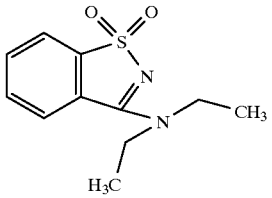

3

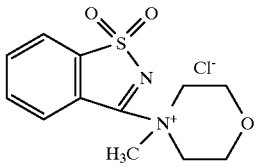

4

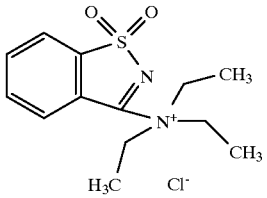

The preparation of compound 1 is described in Example 2, while the preparation of compounds 2 and 3 was carried out in analogy to Examples 1 and 3

TABLE 1

| Catalyst No. | ΔΔR (SULF-WMP) on tea | ΔΔR (SULF-WMP) on red wine |
|---|---|---|
| 1 | 8.9 | 14.0 |
| 2 | 7.6 | 11.8 |
| 3 | 8.0 | 13.5 |

Further useful properties of the sulfonylimine derivatives are minimal impairment of color and minimal fiber damage.

What is claimed is:

1. A process for catalysis of bleach comprising the steps of:

providing a bleach: and adding a bleach catalyst compound of the formula

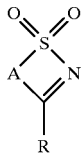

in which R is $$\underline{\text{—}NR^1R^2(R^3)_a}$$

where a is 0 or 1, $R^1$ is $C_1$- to $C_{24}$-alkyl, $R^2$ is hydrogen, or a $C_1$- to $C_{24}$-alkyl, $R^3$ is hydrogen, or a $C_1$- to $C_4$-alkyl, or $R^1$ and $R^2$ together form a 5- to 7-membered heterocycle which as well as the nitrogen atom also contains an oxygen atom in the ring, A is a radical of the formula (c)

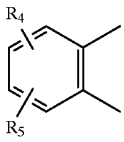

$R_4$ is hydrogen, $R_5$ is hydrogen.

2. A process for the catalysis of bleach as claimed in claim 1, wherein $R^2$ is hydrogen.

3. A process for the catalysis of bleach as claimed in 1, wherein $R^1$ and $R^2$ together form a morpholine ring and wherein $R^3$ is a methyl group.

4. A process for the catalysis of bleach as claimed in claim 1, wherein $R^1$ is a $C_1$- to $C_4$-alkyl.

5. A process for the catalysis of bleach as claimed in claim 1, wherein $R^2$ is a $C_1$- to $C_4$-alkyl.

* * * * *